US008348545B1

(12) United States Patent
Hughes, Jr.

(10) Patent No.: US 8,348,545 B1
(45) Date of Patent: Jan. 8, 2013

(54) TRAFFIC CONTROL MARKER WITH PROTECTIVE COVER AND STIFFENING ELEMENTS

(76) Inventor: Robert K. Hughes, Jr., Fort Myers, FL (US)

( * ) Notice: Subject to any disclaimer, the term of this patent is extended or adjusted under 35 U.S.C. 154(b) by 232 days.

(21) Appl. No.: 12/844,730

(22) Filed: Jul. 27, 2010

Related U.S. Application Data

(63) Continuation-in-part of application No. 12/623,144, filed on Nov. 20, 2009, now Pat. No. 8,202,020.

(60) Provisional application No. 61/116,464, filed on Nov. 20, 2008, provisional application No. 61/230,053, filed on Jul. 30, 2009.

(51) Int. Cl.
*E01F 9/017* (2006.01)

(52) U.S. Cl. ..... 404/10; 40/608

(58) Field of Classification Search ..... 404/9, 10; 116/63 R; 40/608
See application file for complete search history.

(56) References Cited

U.S. PATENT DOCUMENTS 4,511,281 A * 4/1985 Schmanski ..... 404/10
4,516,756 A * 5/1985 Beatty ..... 256/1
4,522,530 A * 6/1985 Arthur ..... 404/10
4,636,108 A * 1/1987 Duckett ..... 404/10
5,205,236 A 4/1993 Hughes
5,323,583 A * 6/1994 Venegas, Jr. ..... 52/309.4
5,374,137 A * 12/1994 Steinberg ..... 404/9
5,921,199 A * 7/1999 Gross ..... 116/28 R
6,209,276 B1 * 4/2001 Venegas, Jr. ..... 52/301
7,150,117 B2 * 12/2006 Venegas, Jr. ..... 40/580
7,901,156 B2 * 3/2011 McCue et al. ..... 404/9
8,202,020 B2 * 6/2012 Hughes, Jr. ..... 404/9

* cited by examiner

*Primary Examiner* — Gary S Hartmann
(74) *Attorney, Agent, or Firm* — Bracewell & Giuliani LLP

(57) ABSTRACT

A clear protective cover on a roadway marker for protecting reflective sheeting located on the marker. The protective cover prevents the reflective sheeting from being displaced from the marker when impacted, for example, by vehicle. The protective cover can be formed from a clear, high-impact strength, polycarbonate material. A stiffening element located within the roadway marker increases the stiffness and resiliency of the roadway marker. The stiffening element provides more spring to return the roadway marker back to a substantially erect position after being deflected, for example, by a vehicle. The stiffening element can be a formed from a hard material such as PVC and can have the shape of a ball, cylinder, puck, oblong, or other suitable shape.

22 Claims, 5 Drawing Sheets

Fig. 5
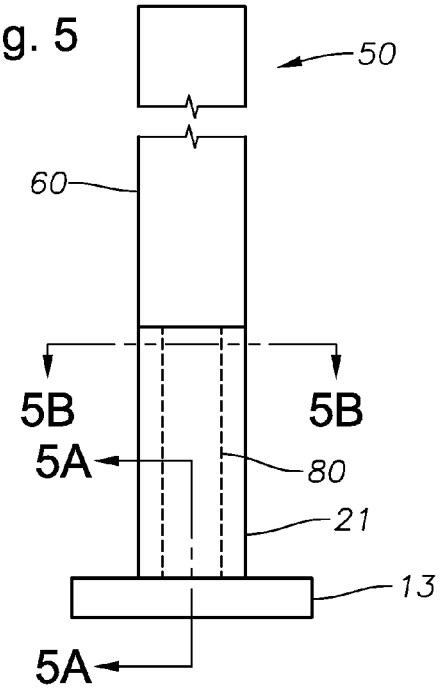
Fig. 6
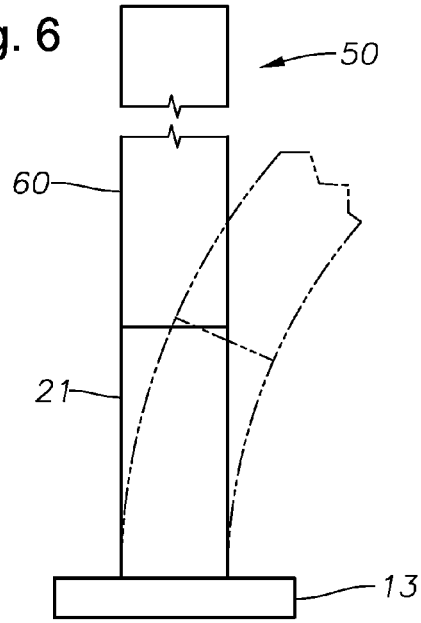
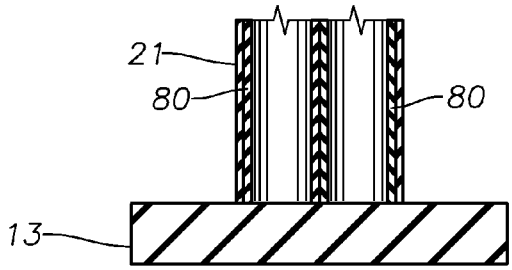
Fig. 5A
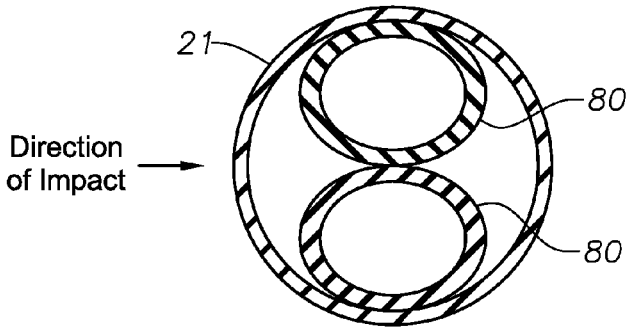
Fig. 5B

TRAFFIC CONTROL MARKER WITH PROTECTIVE COVER AND STIFFENING ELEMENTS

CROSS-REFERENCE TO RELATED APPLICATION

This application is a continuation-in-part of Ser. No. 12/623,144, filed Nov. 20, 2009, which claims the provisional filing date of Nov. 20, 2008, Ser. No. 61/116,464. This application claims priority to provisional application 61/230,053, filed Jul. 30, 2009, the contents of which are incorporated herein by reference in its entirety.

FIELD OF THE INVENTION

This invention relates in general to traffic control markers and, in particular, to a traffic control marker having a clear, protective cover and stiffening elements.

BACKGROUND OF THE INVENTION

Traffic control devices used on roadways or other marking areas are frequently struck by vehicles. These traffic control devices typically have reflective sheeting that partially or completely surrounds the device to warn or guide drivers at night. If the reflective sheeting is not adequately protected, the reflective sheeting is often displaced from its intended location on the traffic control device. Examples of commonly used traffic control devices include traffic cones and barrels. To prevent inadvertent displacement of reflective sheeting on traffic control devices such as traffic cones or barrels, a traffic control device with protection for the reflective sheeting is needed.

Another type of traffic control device is a flexible, strap-like highway marker that is secured within a base. Such traffic control devices, however, are frequently struck by vehicles and can often permanently deform to the point that they cannot stand upright and function correctly.

Thus, it would be desirable to provide a flexible highway marker capable of resisting repeated strikes to thereby improve the functioning life of the highway marker, and maintaining the performance of known types of flexible highway markers when vehicles deflect them on the roadway or other marking area.

SUMMARY OF THE INVENTION

In an embodiment of the present technique, a roadway marker includes a base, a stake that can be driven into the roadway, a pin and a collar, and a flexible marker secured to the base by the pin and collar and protruding upward, is presented. This embodiment further includes a reflective tubular component that can fit over the flexible marker. A reflective sheet is affixed to the exterior of the reflective component and a substantially clear protective cover slides over the reflective component. The protective cover protects the reflective sheet from the impact of vehicles. Stiffening element may also be housed within a portion of the flexible marker.

The roadway marker allows for effective warning of automobile drivers of the conditions of the roadway. In an example embodiment, when impacted, the reflective sheeting on the reflective component is not substantially displaced or removed from its previous intended position during impact due to the protective cover advantageously receiving the impact to thereby protect the reflective sheeting. Further, the stiffening element within the flexible marker, advantageously prevents the marker from collapsing when the marker is struck by a vehicle and bent, and provides additional spring to return the roadway marker to a substantially erect position. The stiffening element can have various shapes, including a ball, a puck, a cylinder, or oblong. The stiffening element may be formed from a resilient or hard material such as plastic, rubber, PVC pipe segments. Additionally, the stiffening element within the flexible marker provides more strength and resiliency to the roadway marker.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

FIG. 5 is an illustration of one embodiment of a traffic marker with stiffening elements, constructed in accordance with the invention;

FIG. 5A is a side sectional view of the stiffening elements of the traffic marker in FIG. 5, constructed in accordance with the invention;

FIG. 5B is a downward looking sectional view of the stiffening elements of the traffic marker in FIG. 5, constructed in accordance with the invention;

FIG. 6 is an illustration the traffic marker deflecting, and constructed in accordance with the invention;

DETAILED DESCRIPTION OF THE INVENTION

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
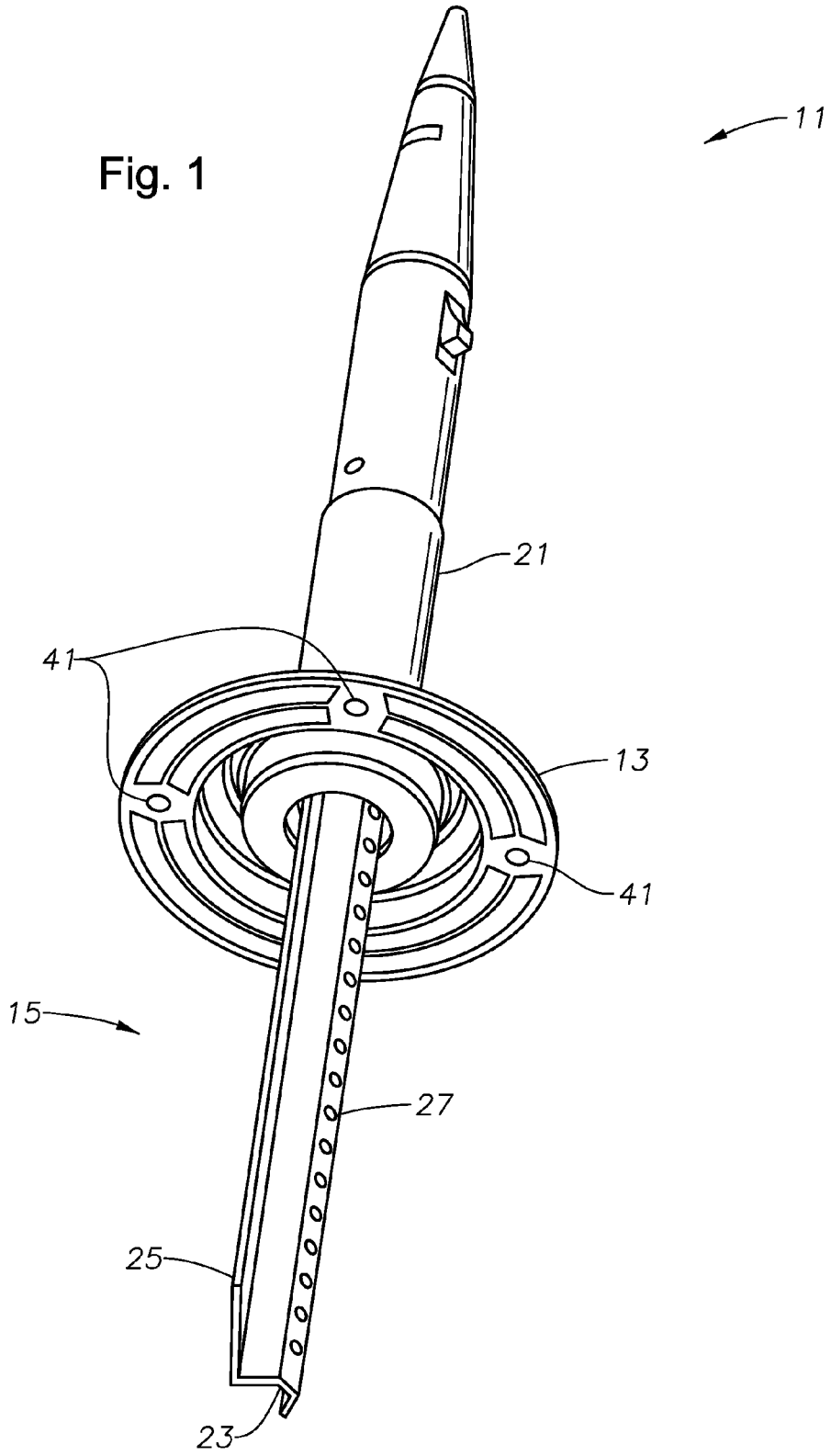
FIG. 1 is an isometric view of one embodiment of a traffic marker constructed in accordance with the invention.

An example embodiment of a flexible delineator 11 for marking roadways or other marking areas is shown in a side perspective view in FIG. 1. The flexible delineator 11 may also be referred to as a traffic control assembly or roadside marker. The embodiment of the traffic control assembly 11 generally includes a base 13, a stake 15, a pin 17 (FIG. 2), a collar 19 (FIG. 2), and a flexible marker 21 that extends substantially vertically from the base 13 when in a non-impacted and non-deformed state.

Figure 2:
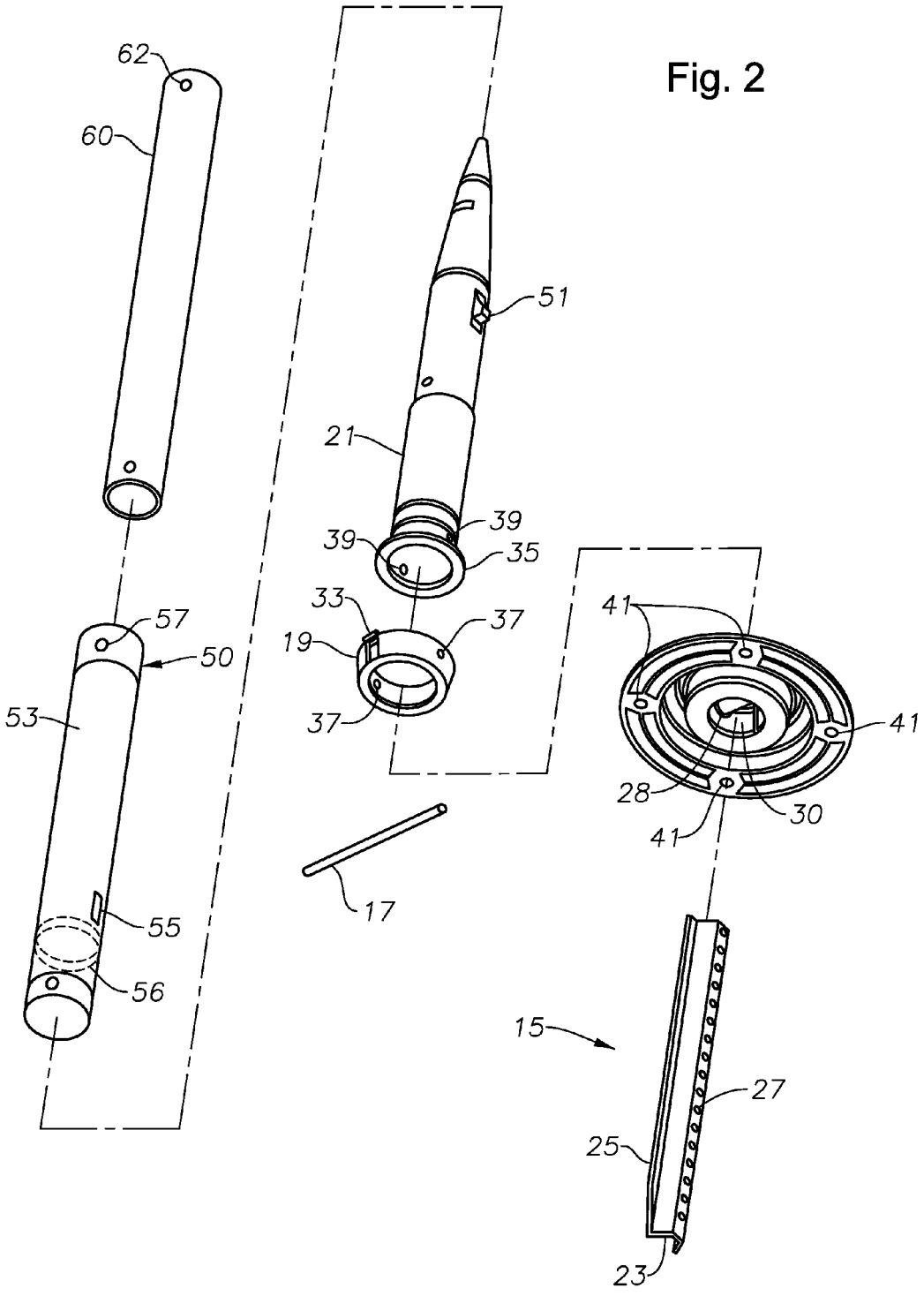
FIG. 2 is an exploded isometric view of one embodiment of the traffic marker of FIG. 1 and is constructed in accordance with the invention.
Figure 3:
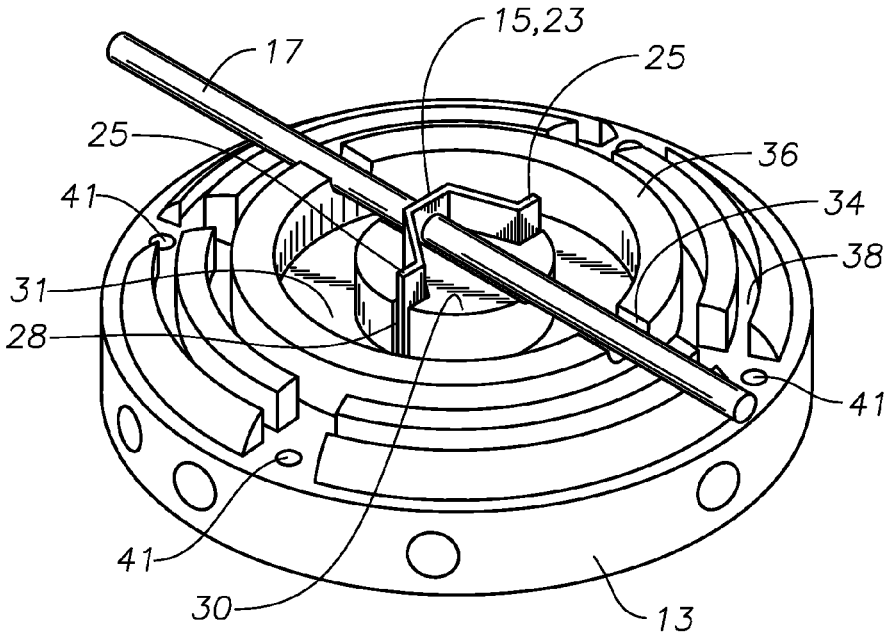
FIG. 3 is an enlarged isometric view of one embodiment of a lower portion of the traffic marker of FIG. 1 and is constructed in accordance with the invention.

The base 13 of FIG. 1 is shown as a generally disk like member, but may also be a configured square, rectangular, round, elongated oval, or alternatively any other suitable shape. The base 13 may be secured to a roadway with the stake 15 or other means. As best shown in FIGS. 2 and 3, the stake 15 may be an elongate u-shaped channel 23 with flanges 25 projecting from lateral sides, and a series of holes 27 extending along the length of u-shaped channel 23. The stake 15 may be formed from metals, metal alloys such as steel, or composites such as plastic. The various shapes of the base 13 may be suitable for uneven terrain to better stabilize the stake 15 when the surface of the supporting ground is not level. For example, on a roadway having a sloped shoulder, a base 13 with an elongated shape (e.g., oval 4 inches by 18 inches), with the elongate side of the base 13 parallel to the roadway, may be used to better follow the contour of the shoulder in which the marker 11 is located.

In another embodiment, only the uppermost hole 27 in stake 15 is minimally required to retain the device 11. The stake 15 may be provided with a length of approximately 6 to 24 inches, and an overall width of about two inches. An upper portion of the stake 15 extends through a complementary-shaped slot 28 formed in a central hub 30 of the base 13. The stake 15 may extend above the hub 30 by a distance of about 1/16-inch to about 12-inches above ground, depending on the application.

Shown in FIG. 3, the base 13 has an annular recess 31 formed on its upper surface encircling the hub 30. Surrounding the recess 31 are concentric walls 36 separated by annular grooves 38. The surface of the outermost wall 36 curves radially inward on its side adjacent the outer edge of the disk 13. The height of each wall 36 progressively increases proximate to the hub 30. Accordingly, radial grooves 34 are provided in the innermost wall 36 to accommodate the pin 17. The collar 19 (FIG. 2) has a ring-shaped configuration that seats in the recess 31 to circumscribe the hub 30. Collar 19 may be provided with an alignment feature 33 that is complementary to a feature on base 15 to orient collar 19 relative to base 13 and stake 15. A lip on the lower end of collar 19 seats a circumferential flange 35 shown circumscribing the bottom of marker 21. Both collar 19 and marker 21 are provided with through holes 37, 39, respectively. Base 13 also may be provided with such holes or features. Significantly, the base 13 prevents the stake 15 from listing or extraneous movement once these components are secured together. In effect, this design keeps the portion of the stake 15 that is above ground from listing as well, and substantially maintains a perpendicular relationship therebetween.

Stake 15 is driven into the ground such that only a few inches of its length extend about the surface of the ground. The base 13 is then placed on the stake 15 such that the upper portion of the stake is positioned in slot 28. Next, the collar 19 is placed in the recess 31 with the open upper surface of the collar 19 facing upward. The bottom or flange 35 of the marker 21 is then placed in the collar 19 such that holes 37 and 39 align with one of the holes 27 formed in the stake 15. The pin 17 is then extended laterally through the holes 37, 39, 27 to secure the entire assembly to each other and to the ground.

In one embodiment, the upper portion of marker 21 comprises ears 51 that are locking retention features for retaining a reflective component 50. In the example of FIG. 2, the ears 51 project from a side of the marker 21 having an upper surface that is along a curved path generally oblique to an axis of the marker 21. A lower surface of the ears 51 is substantially perpendicular to an axis of the marker 21. Reflective component 50 may comprise a plastic tubular member as shown with indicia or reflective sheeting 53 for greater visibility to traffic. The reflective sheeting 53 may be affixed to the reflective component 50 via adhesives such as glue. Alternatively, the component 50 can be painted with reflective or fluorescent paint, or reflective or fluorescent beads can be attached to the component 50. The ears 51 are resilient members that slip through component 50 and lock into holes 55 formed in the sides thereof. In this embodiment, a metallic reinforcing ring 56 is embedded within component 50 below the locking holes 55. The reinforcing ring 56 makes the component 50 more resistant to tearing, ripping, or breaking. The location of the reinforcing ring 56 within component 50 can vary depending on where stress dispersion is required, such as for example at the base of the component 50 if it is directly mounted to the base 13. After component 50 is installed on marker 21, it may be removed by pressing the ears 51 inward and out of the holes 55, allowing the component 50 to be replaced. Alternatively, the component 50 may be removed by cutting or deforming component 50.

As shown in FIG. 2, in one embodiment a protective, cylindrical sleeve or cover 60 may slide over the reflective component 50. The protective sleeve 60 may be fastened to the reflective component 50 by bolts (not shown) that extend through holes 62 on the protective sleeve 60 aligned with holes 57 on the reflective component 50. The protective sleeve 60 has a toughness that is equal to or greater than that of the reflective component 50 or marker 21. The sleeve 60 can be made of a clear, high-impact strength, polycarbonate material, or any hard, non-brittle material, that can protect the reflective sheeting 53 from the impact of vehicles without compromising its reflective function. An example of another material for the sleeve 60 could be a clear acrylic and may be either flexible or rigid. The sleeve 60 may have an inner diameter ranging from ½" diameter to 10" in diameter and a wall thickness ranging from 0.020" to 0.75", depending on the application.

Referring to FIG. 3, the base 13 may also include holes 41 shown spaced apart about its outer circumference and axially through the base 13. The holes 41 provide an alternate mounting option for the base 13 to a roadway or other marking area with fasteners. The holes 41 may receive fasteners, such as screws, for mounting the base 13 to the roadway. Alternatively, the base 13 also may be mounted to the roadway with an adhesive such as epoxy applied to its underside, whereby the adhesive fills the holes 41 when the underside of the base 13 is pressed against the roadway.

Figure 4:
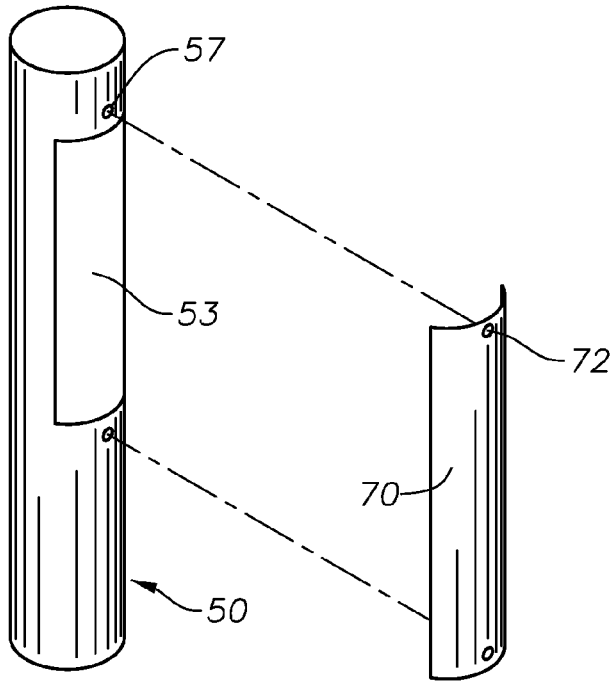
FIG. 4 is an exploded isometric view of one embodiment of a traffic marker constructed in accordance with the invention.

In another embodiment illustrated in FIG. 4, which is one of many possible embodiments, a protective cover 70 only protects the portion of the reflective component 50 having reflective sheeting 53. The reflective sheeting is sandwiched between the protective cover 70 and the reflective component and the cover 70 can be fastened to the reflective component 50 by fasteners such as bolts (not shown) that extend through holes 72 on the protective cover 70 aligned with holes 57 on the reflective component 50. The protective cover 70 may be a clear, high-impact strength, polycarbonate material and may also be curved, to fit the cylindrical contour shape of the reflective component 50.

The flexible marker 21 is sufficiently thick to resist casual bending or flexing along its length from forces such as a strong wind. As such, the marker 21 remains substantially vertically upright when in a non-deformed state when the marker 21 is not forcibly impacted by a physical object. The flexible marker 21 is sufficiently flexible so that the marker 25 will elastically deform along its length when a physical object forcibly applies a significant impact on the flexible marker 21, such as by a moving vehicle or automobile.

In operation, when a moving vehicle (not shown) strikes the traffic control assembly 11, it is designed to allow the flexible marker 21 to elastically deform before returning to an upright position after impact. When the tire of the vehicle strikes the traffic control assembly 11, the tire rolls onto the walls 36 of the base 13 before striking the flexible marker 21. The increasing height of the walls 36 elevates the tire above the stake 15 to prevent the stake 15 from puncturing the tire. Upon impact from the tire, the marker 21 flexes or bends. The bottom portion of the flexible marker 21 remains securely affixed to base 13. After the vehicle and tire move past the traffic control assembly 11, the resilient elastic properties of the flexible marker 21 allow it to return to an upright position. However, the repeated impact and vehicle weight can cause the bottom portion of the flexible marker 21 to permanently bend or deform to the point that it does not return to an upright position.

To improve the elastic properties of the bottom portion of the flexible marker 21, a stiffening element 80 can be located inside the bottom portion of the flexible marker 21 as shown in FIGS. 5, 5A, and 5B. Stiffening element 80 may be formed from a resilient or hard material such as plastic, rubber, PVC pipe segments, etc. Although stiffening element 80 is depicted as two upright rubber tube segments, it may comprise more or less rubber segments, may be solid, and may have many other shapes (e.g., a ball, a puck, a cylinder, oblong, etc.). Moreover, although the stiffening element 80 is depicted as filling substantial portion of the bottom portion of the marker 21, it may be larger or smaller, depending on the application.

As shown in FIG. 5B, the stiffening elements 80 may have an oblong cross-section and preferably have diameters that combine to be larger than the inner diameter of the bottom portion of the marker 21, such that the stiffening elements 80 deform when located within the bottom portion of the marker 21. In this embodiment, the stiffening elements 80 are aligned side-by-side with elongate sides aligned to the direction of impact. The presence of a stiffening element 80 deters the bottom portion of the marker 21 from collapsing when the traffic control device is bent, as illustrated in FIG. 6. Furthermore, stiffening element 80 may be provided at a thickness or diameter that causes the bottom portion of the marker 21 to expand (e.g., stretch) when stiffening element 80 is installed within it. The stretching of the bottom portion of the marker 21 by one or more stiffening element(s) 80 causes the bottom portion of the marker 21 to become selectively more resilient and have more spring to return the marker 21 (and, e.g., any signage) to the erect or substantially erect position. In this embodiment, he stiffening elements 80 may be loosely held within the marker 21 or attached to the base 13 such that the stiffening elements 80 do not add additional weight to the flexible marker 21. Additional weight on the flexible marker 21 may make the marker 21 more susceptible to being destroyed during impact due to increased inertia. Alternatively, a cap (not shown) may be located within the marker 21 above the stiffening elements 80 to provide an additional aid to maintain them in a desired position.

The invention has several important advantages. The protective sleeve or cover on traffic control assembly effectively protects the reflective sheeting, such that when impacted the reflective sheeting on the traffic control assembly is not displaced from its intended position. The invention extends the functional life of the reflective sheeting of the traffic control assembly. The invention also improves the elastic properties of the traffic control device through the use of a reinforcing ring and stiffening elements to thereby increase life and improve performance. Further, while protecting the reflective function and improving the elastic properties of the traffic control device, the invention maintains the same optimum performance as the previous wide flexible highway markers in the industry when vehicles deflect them on the roadway or on another marking area.

Figure 7:
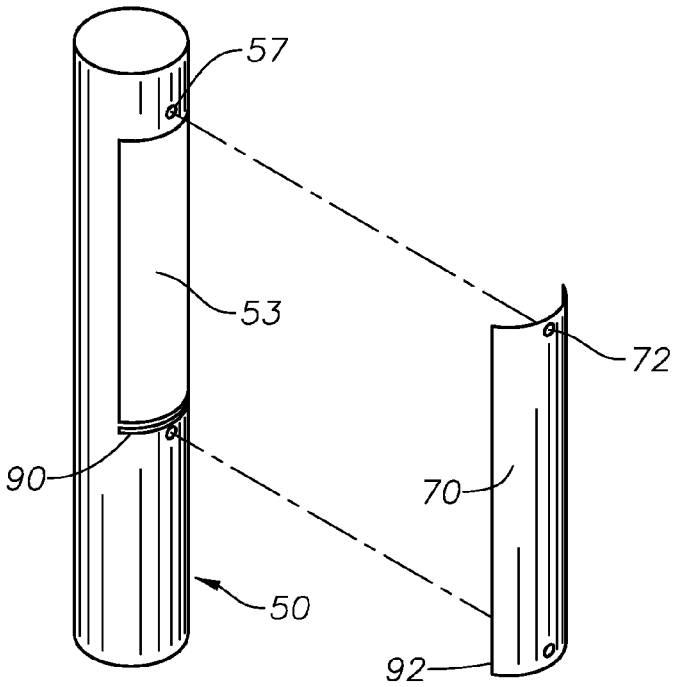
FIG. 7 is an exploded isometric view of one embodiment of a traffic marker constructed in accordance with the invention.
Figure 7A:
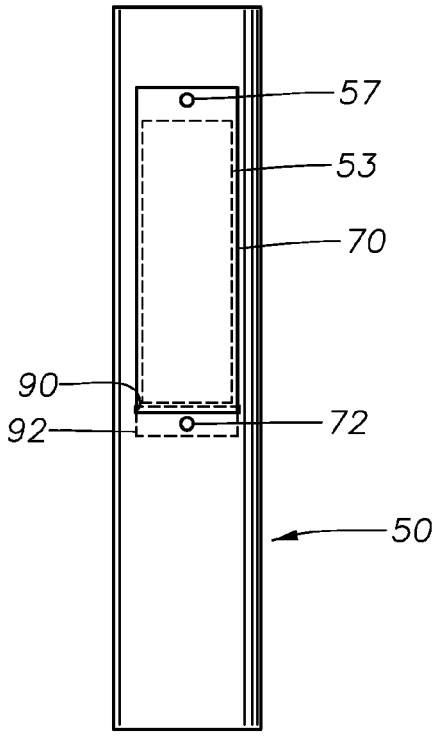
FIG. 7A is a front view of the assembled traffic marker in FIG. 7, constructed in accordance with the invention.

In another embodiment illustrated in FIG. 7, which is one of many possible embodiments, a slit or pocket 90 is formed on the reflective component 50 above the lower of the two fastener hole 57. The pocket 90 is sized to correspondingly receive a bottom portion 92 of the protective cover such that the lower portion 92 of the cover 70 is within the reflective component 50. In this embodiment the protective cover 70 only protects the portion of the reflective component 50 having reflective sheeting 53. The reflective sheeting is sandwiched between the protective cover 70 and the reflective component and the cover 70 can be fastened to the reflective component 50 by fasteners such as bolts (not shown) that extend through holes 72 on the protective cover 70 aligned with holes 57 on the reflective component 50. However, as previously described, the hole 72 on the lower portion 92 of the cover 70 will be within the pocket 90 formed on the reflective component 50 and will align with the lower hole 57 on the component 50 as shown in FIG. 7A. The protective cover 70 may be a clear, high-impact strength, polycarbonate material and may also be curved, to fit the cylindrical contour shape of the reflective component 50. The location of the lower portion 92 of the cover 70 within the pocket 90 prevents the lower portion 92 of the cover 70 from snagging to a vehicle during impact, minimizing the potential for displacement of the cover 70 from the reflective component 50.

In another embodiment, a clear tube can be extruded over the component 50 and reflective sheeting 53 to provide a clear, protective cover. The extruded tube further creates a barrier against moisture and dust.

In another embodiment, the component 50 and reflective sheeting 53 are dipped into a clear coat. The clear coat provides a clear, protective cover for the reflective sheeting 53.

While the invention has been shown or described in only some of its forms, it should be apparent to those of ordinary skill in the art that it is not so limited, but is susceptible to various changes without departing from the scope of the invention.

I claim:

1. A roadway warning apparatus, comprising:
- a base selectively mountable adjacent a roadway;
- a flexible tubular member rigidly connected to the base;
- a tubular reflective member coaxially mounted on the flexible tubular member; and
- a substantially transparent and annular protective sleeve circumscribing the tubular reflective member, a lower end of the substantially transparent and annular protective sleeve being spaced a selected distance above the base, so as not to impede the bending of the flexible tubular member between the base and the lower end of the substantially transparent and annular protective sleeve.

2. The apparatus according to claim 1, further comprising a stiffening element located within an axial cavity in the flexible tubular member.

3. The apparatus according to claim 1, further comprising a reflective sheet between the tubular reflective member and the substantially transparent and annular protective sleeve.

4. The apparatus according to claim 3, wherein the substantially transparent and annular protective sleeve is approximately the same size and shape as the reflective sheet on the tubular reflective member.

5. The apparatus according to claim 1, wherein the substantially transparent and annular protective sleeve comprises polycarbonate.

6. The apparatus according to claim 2, wherein the stiffening element comprises two side-by-side resilient elongated tubulars having elongated sides that are aligned with an expected direction of impact.

7. The apparatus according to claim 2, wherein the stiffening element comprises an oblong cross-section when the stiffening element is inserted within the flexible tubular member.

8. The apparatus according to claim 2, wherein the stiffening element is free to laterally move within the cavity.

9. The apparatus according to claim 2, wherein the stiffening element has a size that causes the flexible tubular member to radially expand when the stiffening element is installed within the flexible tubular member.

10. The apparatus according to claim 2, wherein the stiffening element is formed from a hard material and comprises at least one of the following:

a.) a spherical ball; or b.) a cylinder.

11. The apparatus according to claim 2, wherein the stiffening element is formed from one of the following:

a.) plastic;

b.) rubber; or c.) polyvinyl chloride.

12. The apparatus according to claim 2, wherein the stiffening element has a total width greater than an inner diameter of the flexible tubular member, so that when installed, the stiffening element is configured to flex into an oblong cross-sectional shape.

13. A roadway warning apparatus, comprising:

a base selectively mountable adjacent a roadway;

a flexible tubular member rigidly connected to the base;

a tubular reflective member coaxially mounted on the flexible tubular member;

a substantially transparent and annular protective sleeve circumscribing the tubular reflective member; and a reflective sheet between the tubular reflective member and the substantially transparent and annular protective sleeve, wherein a lower end of the substantially transparent and annular protective sleeve is spaced a selected distance above the base, so as not to impede the bending of the flexible tubular member between the base and the lower end of the substantially transparent and annular protective sleeve.

14. The apparatus according to claim 13, further comprising a stiffening element located within an axial cavity in the flexible tubular member.

15. The apparatus according to claim 13, wherein the substantially transparent and annular protective sleeve is approximately the same size and shape as the reflective sheet on the tubular reflective member.

16. The apparatus according to claim 13, wherein the substantially transparent and annular protective sleeve comprises polycarbonate.

17. The apparatus according to claim 14, wherein the stiffening element comprises two side-by-side resilient elongated tubulars having elongated sides that are aligned with an expected direction of impact.

18. The apparatus according to claim 14, wherein the stiffening element comprises an oblong cross-section when the stiffening element is inserted within the flexible tubular member.

19. The apparatus according to claim 14, wherein the stiffening element has a size that causes the flexible tubular member to radially expand when the stiffening element is installed within the flexible tubular member.

20. The apparatus according to claim 14, wherein the stiffening element is formed from a hard material and comprises at least one of the following:

a.) a spherical ball; or b.) a cylinder.

21. The apparatus according to claim 14, wherein the stiffening element is formed from one of the following:

a.) plastic;

b.) rubber; or c.) polyvinyl chloride.

22. The apparatus of claim 14, wherein the stiffening element has a total width greater than an inner diameter of the flexible tubular member, so that when installed, the stiffening element is configured to flex into an oblong cross-sectional shape.

* * * * *